US006387249B1

(12) United States Patent
Cook et al.

(10) Patent No.: US 6,387,249 B1
(45) **Date of Patent: *May 14, 2002**

(54) HIGH TEMPERATURE DEPRESSURIZATION FOR NAPHTHA MERCAPTAN REMOVAL

(75) Inventors: Bruce R. Cook, Stewartsville; Richard H. Ernst, Glen Gardner; Richard A. Demmin, Highland Park; John P. Greeley, Annandale, all of NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/685,709

(22) Filed: Oct. 10, 2000

Related U.S. Application Data

(63) Continuation-in-part of application No. 09/470,267, filed on Dec. 22, 1999.

(51) Int. Cl.[7] ..... C10G 45/06

(52) U.S. Cl. ..... 208/216 R; 208/213; 208/217; 208/228

(58) Field of Search ..... 208/213, 216 R, 208/217, 228

(56) References Cited

U.S. PATENT DOCUMENTS

| | | | | |
|---|---|---|---|---|
| 3,714,031 A | * | 1/1973 | Van Der Toorn et al. | 208/213 |
| 3,732,155 A | * | 5/1973 | Cecil et al. | 208/210 |
| 4,149,965 A | | 4/1979 | Pine et al. | 208/216 R |
| 4,243,519 A | | 1/1981 | Schorfheide | 208/210 |
| 5,318,690 A | * | 6/1994 | Fletcher et al. | 208/89 |
| 5,423,975 A | | 6/1995 | Sudhakar et al. | 208/216 R |
| 5,525,211 A | | 6/1996 | Sudhakar et al. | 208/217 |
| 5,906,730 A | | 5/1999 | Hatanaka et al. | 208/210 |

* cited by examiner

*Primary Examiner*—Bekir L. Yildirim
(74) *Attorney, Agent, or Firm*—Gerard J. Hughes

(57) ABSTRACT

The invention relates to naphtha hydrodesulfurization incorporating either high temperature depressurization or controlled heating for mercaptan removal. More particularly, the invention relates to a naphtha hydrodesulfurization process, wherein the hot naphtha exiting the desulfurization reactor contains mercaptans, most of which are removed without olefin loss, by depressurizing the hot naphtha, thermally treating the hot naphtha, or some combination thereof. The desulfurized naphtha may be cooled and condensed to a liquid, separated from the gaseous $H_2S$, stripped and sent to a mogas pool.

25 Claims, 4 Drawing Sheets

HIGH TEMPERATURE DEPRESSURIZATION FOR NAPHTHA MERCAPTAN REMOVAL

CROSS-REFERENCE TO RELATED APPLICATION

This application is a continuation-in-part of U.S. Ser. No. 09/470,267 filed Dec. 22, 1999.

FIELD OF THE INVENTION

The invention relates to naphtha hydrodesulfurization incorporating high temperature depressurization for mercaptan removal. More particularly, the invention relates to a naphtha hydrodesulfurization process, wherein the hot naphtha exiting the desulfurization reactor contains mercaptans, most of which are removed without olefin loss, by depressurizing the hot naphtha, thermally treating the hot naphtha, or some combination thereof. The desulfurized naphtha may be cooled and condensed to a liquid, separated from the gaseous $H_2S$, stripped and sent to a mogas pool.

BACKGROUND OF THE INVENTION

Motor gasoline ("mogas") specifications are increasingly stringent, particularly with regard to sulfur content. Future regulations are expected to require that mogas contain no more than about 150 wppm of sulfur, as low as 30 wppm, or less. Such sulfur specifications may require the production of low sulfur blend stock for the mogas pool. The primary sulfur sources in the mogas pool are the blend stocks derived from fluidized catalytic cracking ("FCC") of heavy oil, gas oil, and the like to form naphthas having a sulfur content in the range of 1000–7000 wppm depending upon crude quality and FCC operation. Conventional fixed bed hydrodesulfurization can reduce the sulfur level of FCC naphthas to very low levels, but the severe conditions of temperature, pressure and treat gas velocity results in significant octane number loss, due to extensive loss of olefins by saturation. Selective and severe hydrodesulfurization processes have been developed to avoid massive olefin saturation and octane loss. Such processes are disclosed, for example, in U.S. Pat. Nos. 4,149,965; 4,243,519; 5,423,975; 5,525,211 and 5,906,730. However, in these and in other processes, in the hydrodesulfurization reactor the liberated $H_2S$ reacts with the retained olefins, to form mercaptan sulfur compounds. Depending on the amount of sulfur and olefins in the naphtha feed, the concentration of these reversion reaction product mercaptans typically exceeds fuel specifications for mercaptan sulfur and, in some cases, total sulfur.

For example, during naphtha hydrodesulfurization, the raw feed reacts with hydrogen in the presence of a hydrodesulfirization catalyst, at conditions of elevated temperature and pressure. This converts sulfur in organic sulfur-bearing compounds in the feed to $H_2S$ and forms a mixture of hot desulfurized feed and $H_2S$. However, during the hydrodesulfurization, the $H_2S$ formed reacts with olefins in the feed to form mercaptans, irrespective of whether or not the feed being desulfurized contains mercaptans. These mercaptans formed as a consequence of the desulfurization are referred to as reversion mercaptans.

Generally it has been found that the mercaptans present in the hydrodesulfurized product have a higher carbon number than those found in the feed. These reversion mercaptans formed in the reactor, and which are present in the desulfurized product, typically comprise $C_{4+}$ mercaptans. Others have proposed reducing the mercaptan and/or total sulfur of the hydrodesulfurized naphtha product by means such as 1) pretreating the feed to saturate diolefins, 2) extractive sweetening of the hydrotreated product, and 3) product sweetening with an oxidant, alkaline base and catalyst. However, none of these processes converts mercaptans.

It would therefore be desirable to convert mercaptans, particularly reversion mercaptans, to $H_2S$ and olefins in order to provide a further desulfurized naphtha without an undesirable loss in naphtha octane number.

SUMMARY OF THE INVENTION

The invention relates to high temperature depressurization for removing mercaptans including reversion mercaptans from hydrodesulfurized naphtha. More particularly, the invention relates to a naphtha desulfurization process, which comprises:

(a) hydrodesulfurizing a naphtha which contains olefins and sulfur in the form of organic sulfur compounds, to form a hydrodesulfurization effluent comprising a hot mixture of sulfur reduced naphtha, $H_2S$ and mercaptans, and then (b) rapidly depressurizing at least a portion of the hydrodesulfurization effluent to destroy at least a portion of the mercaptans to form more $H_2S$ and a depressurized naphtha further reduced in sulfur.

In a preferred embodiment, the invention further comprises separating the $H_2S$ from the depressurized naphtha.

The depressurization is conducted at a high temperature, which is typically at least the temperature of the hydrodesulfurized naphtha effluent exiting the hydrodesulfurization reactor. The depressurization removes mercaptans without olefin loss due to saturation and even increases the olefin level in the desulfurized naphtha, to an amount slightly (e.g., less than 1 vol. %) higher than it would be without the depressurization.

In another embodiment, the invention relates to a naphtha desulfurization process, comprising:

(a) hydrodesulfurizing a naphtha, the naphtha containing olefins and sulfur in the form of organic sulfur compounds, to form a hydrodesulfurization effluent at an initial temperature, the effluent comprising a hot mixture of sulfur reduced naphtha, $H_2S$ and mercaptans; and then (b) heating at least a portion of the hydrodesulfurization effluent to a temperature greater than the initial temperature at a substantially constant total pressure to destroy at least a portion of the mercaptans to form more $H_2S$ and a treated naphtha further reduced in sulfur.

In a preferred embodiment, the invention further comprises separating the $H_2S$ from the treated naphtha.

In one embodiment, at least a portion, and more preferably substantially all of the hydrodesulfuriztion effluent is in the vapor phase. In other words, the temperature of the hydrodesulfurization step is controlled so that it is above the dew point in the hydrodesulfurization reactor.

By depressurization is meant reducing the pressure to a level of no more than 50% of the pressure in the hydrodesulfurizing desulfurizing reactor, preferably no more than 25% and more preferably down to a level of no more than 10 % of that at the exit end of the reactor. In an absolute sense, the pressure after depressurization will be no more than 300 and preferably no more than 200 psig. If the hydrodesulfurization reactor is running at a fairly low pressure of 150 psig or less, the low pressure resulting from the depressurization will preferably be less than 25 psig and more preferably about atmospheric pressure. Preferably, the depressurization occurs in a depressurization reactor or vessel at a depressurization temperature. As the depressurization would be approximately adiabatic, a decrease in the depressurization temperature may be observed during the depressurization. Consequently, there will be an initial depressurization temperature at the start of depressurization and a lower, preferably slightly lower, final depressurization temperature at the conclusion of the depressurization step. For convenience, the depressurization temperature referred to herein in the initial depressurization temperature. While the depressurization temperature is preferably maintained at no less than the temperature of the hydrodesulfurized naphtha exiting the hydrodesulfurization reactor, it is more preferred that it be at least 10° F. and still more preferably at least 25° F. higher than that temperature. In one embodiment, the hydrodesulfurized naphtha is heated sufficiently so that the final depressurization temperature is above the dew point of the naphtha in the depressurization reactor. If more than one hydrodesulfurizing reactor is employed, it will typically be the effluent from the last reactor that is depressurized. The depressurization is conducted downstream of the hydrodesulfurization reactor or zone, typically in a separate vessel, and with or without the presence of a catalyst effective for increasing the rate of mercaptan decomposition. If a catalyst is present during the depressurization, the presence of hydrogen is preferred to avoid coking of the naphtha hydrocarbons. This process is particularly useful with naphtha feeds high in olefin and sulfur content and particularly with naphthas useful for gasoline, in which olefin retention is important for valuable octane.

DETAILED DESCRIPTION

Figure 1A:
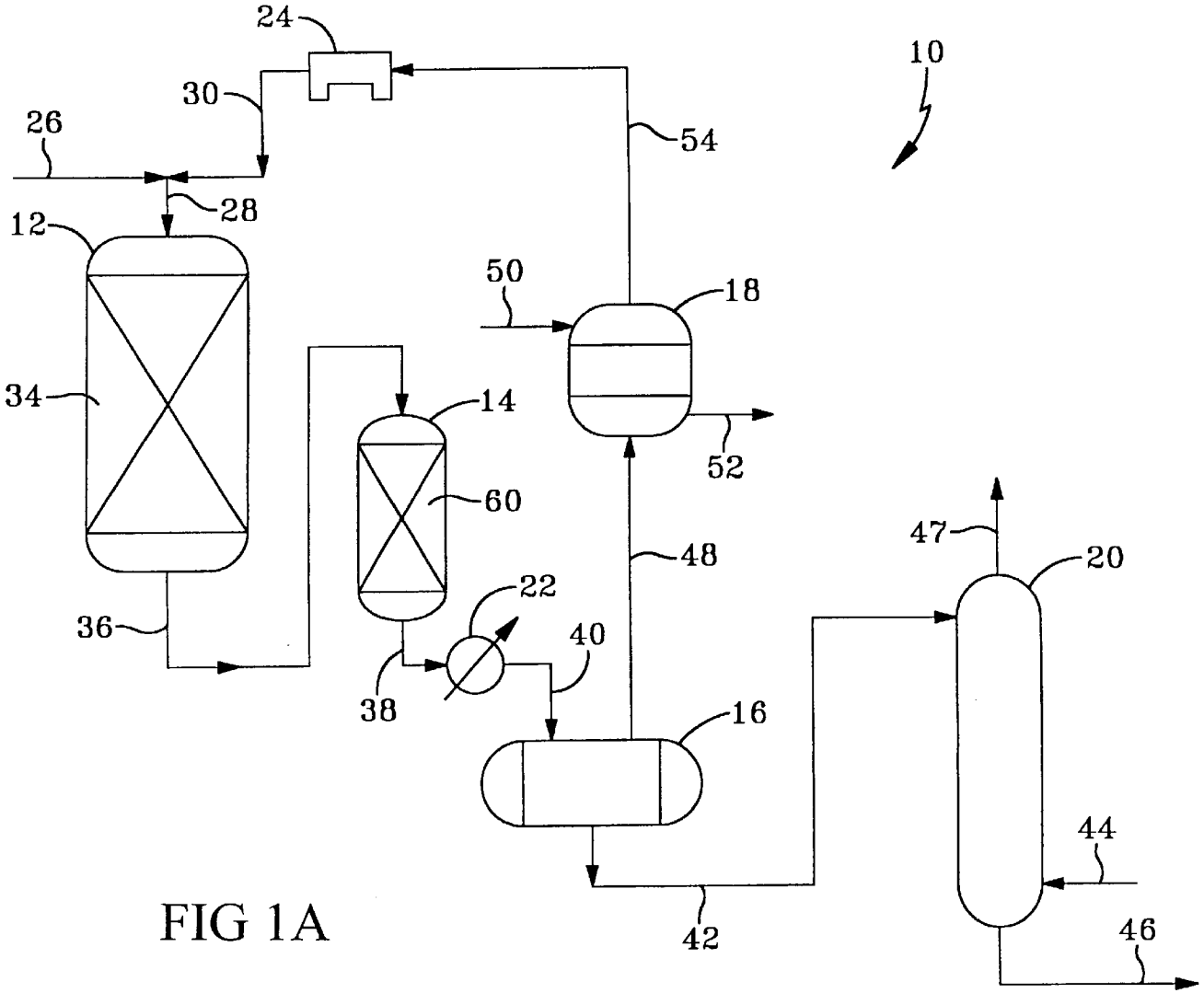
FIG. 1A is a block diagram flow plan of a naphtha desulfurizing process according to one embodiment of the invention involving rapid depressurization of the hydrodesulfurization effluent.

The invention is based in part on the discovery that by rapidly reducing the pressure of the hydrodesulfurization effluent, i.e., the hot mixture of the hydrodesulfurized naphtha and $H_2S$ produced by the hydrodesulfurization, the mercaptan level in the hydrodesulfurized naphtha may be substantially reduced, without saturating the remaining olefins. Moreover, the depressurization may result in a slight increase in olefin content compared to the depressurized naphtha. While not wishing to be bound by any theory or model, it is believed that the lower pressure facilitates the decomposition of at least a portion of the reversion mercaptans and any other mercaptans present in the desulfurized naphtha back to $H_2S$ and sulfur-free hydrocarbons, without further olefin loss.

It has also been discovered that in addition to depressurization of an all gas phase system, mercaptan destruction can be facilitated by a thermal treatment while maintaining the total pressure of the hydrodesulfurization effluent substantially constant. While not wishing to be bound by any theory or model, it has been found that the equilibrium constant for mercaptan formation in the hydrodesulfurization effluent decreases approximately 40% with each temperature increase of about 25° C. Increasing the hydrodesulfurization effluent's temperature by about 100° C. would result in decreasing the equilibrium constant by about 85%.

The olefin and sulfur-containing naphtha feed is preferably selectively hydrodesulfurized to minimize olefin loss by saturation in the desulfurization reactor. Preferably will have an olefin content, after the depressurization or heating, no less than that of the desulfurized naphtha exiting the reactor. Thus, mercaptans are removed and the olefins valuable for octane are preserved. The desulfurized naphtha produced by the depressurization or heating may then be cooled to condense the naphtha to the liquid state, with the condensed naphtha then separated from the gaseous $H_2S$, stripped, and typically conducted to a mogas pool for blending. By using depressurization, heating, or some combination thereof to remove mercaptans from the hydrodesulfurization effluent, the hydrodesulfurization step may be operated at a lower severity in order to preserve the naphtha olefin content while achieving the same overall level of hydrodesulfurization. Even at high hydrodesulfurization severity, the process' econd step permits the recovery of some of the olefins destroyed via mercaptan reversion.

The organic sulfur compounds in a typical naphtha feed to be desulfurized, comprise mercaptan sulfur compounds (RSH), sulfides (RSR), disulfides (RSSR), thiophenes and other cyclic sulfur compounds, and aromatic single and condensed ring compounds. Mercaptans present in the naphtha feed typically have from one to three ($C_1$–$C_3$) carbon atoms. During the hydrodesulfurization process, the mercaptans in the feed are removed by reacting with the hydrogen and forming $H_2S$ and paraffins. It is believed that the $H_2S$ produced in the hydrodesulfurization reactor from the removal of the organic sulfur compounds reacts with the olefins to form new mercaptans (i.e., reversion mercaptans).

As discussed, naphtha may be employed as a feed to the hydrodesulfurization step. While any naphtha may be employed, typical naphtha feeds include catalytically cracked and thermally cracked naphtha. The naphtha may be obtained from one or more petroleum processing units. For example, suitable naphtha feeds may be obtained from one or more FCC units, cokers, steam crackers, and the like. Although the naphtha may be a "full range" naphtha, the naphtha may be separated before use, e.g., in a naphtha splitter. Separated naphthas such as wide-cut naphtha, light cat naphtha, intermediate cat naphtha, and heavy cat naphtha may be employed. Cracked naphthas having an appreciable olefin and sulfur concentration such as intermediate cat naphtha would be particularly useful feeds. Accordingly, in one embodiment, the naphtha feed is one or more cracked naphtha, including fractions thereof, with end boiling points typically below 450° F., and which typically contain 60 vol. % or less olefinic hydrocarbons, with sulfur levels as high as 3000 wppm and even higher (e.g., 7000 wppm). The naphtha feed, preferably a cracked naphtha feedstock, generally contains not only paraffins, naphthenes, and aromatics, but also unsaturates, such as open-chain and cyclic olefins, dienes and cyclic hydrocarbons with olefinic side chains. The olefin content of a typical cracked naphtha feed can broadly range from 5–60 vol. %, but more typically from 10–40 vol. %. In the practice of the invention it is preferred that the olefin content of the naphtha feed be at least 15 vol.

% and more preferably at least 25 vol. %. The sulfur content of the naphtha feed is typically less than 1 wt. %, and more typically ranges from as low as 0.05 wt. %, up to as much as about 0.7 wt. %, based on the total feed composition. However, for a cat cracked naphtha and other high sulfur content naphthas useful as feeds in the selective desulfurization process of the invention, the sulfur content may broadly range from 0.1 to 0.7 wt. %, more typically from about 0.15 wt. % to about 0.7 wt. %, with 0.2–0.7 wt. % and even 0.3–0.7 wt. % being preferred. While the feed's nitrogen content will generally range from about 5 wppm to about 500 wppm, and more typically from about 20 wppm to about 200 wppm, the preferred process is insensitive to the presence of nitrogen in the feed.

As a first step in the process, the naphtha is hydrodesulfurized or otherwise hydroprocessed in a way that removes sulfur. Hydrodesulfurization is sometimes referred to as hydrotreating or hydrorefining, and typically removes nitrogen and other heteroatoms, in addition to sulfur. In one embodiment, it is preferred that the hydrodesulfurization be selective primarily for sulfur removal. The operating conditions employed for naphtha hydrodesulfurization may be conventional, and include temperatures, total pressures and treat gas ratios broadly ranging from about 400 to about 800° F., about 60 to about 2000 psig, and about 200 to about 5000 scf/b. Space velocity typically ranges from about 0.1 to about 10 LHSV, based on the volume of feed, per volume of catalyst, per hour. More narrow conditions which include relatively higher temperatures and lower pressures of from about 500–750° F. and 60–300 psig, along with treat gas ratios of from about 2000–4000 scf/b, have been found to be more selective for sulfur removal in many cases. Higher temperatures and lower pressures improve the selectivity, by favoring hydrodesulfurization with less olefin saturation (i.e., octane number loss).

Conventional hydrodesulfurization ("HDS") catalysts may be employed. Conventional HDS catalysts include those comprising at least one Group VIII metal catalytic component such as Co, Ni and Fe, alone or in combination with a component of at least one metal selected from Group VI, IA, IIA, IB metals and mixture thereof, supported on any suitable, high surface area inorganic metal oxide support material such as, but not limited to, alumina, silica, titania, magnesia, silica-alumina, and the like. The Group VIII metal component will typically comprises a component of Co, Ni or Fe, more preferably Co and/or Ni, and most preferably Co; and at least one Group VI metal catalytic component, preferably Mo or W, and most preferably Mo, composited with, or supported on, a high surface area support component, such as alumina. All Groups of the Periodic Table referred to herein mean Groups as found in the Sargent-Welch Periodic Table of the Elements, copyrighted in 1968 by the Sargent-Welch Scientific Company. Some catalysts employ one or more zeolite components. A noble metal component of Pd or Pt is also used. At least partially and even severely deactivated catalysts have been found to be more selective in removing sulfur with less olefin loss due to saturation. In the practice of the invention it is preferred that the hydrodesulfurization catalyst comprise a Group VIII non-noble metal catalytic component of at least one metal of Group VIII and at least one metal of Group VIB on a suitable catalyst support. Preferred Group VIII metals include Co and Ni, with preferred Group VIB metals comprising Mo and W. A high surface area inorganic metal oxide support material such as, but not limited to, alumina, silica, titania, magnesia, silica-alumina, and the like is preferred, with alumina, silica and silica-alumina particularly preferred. Metal concentrations are typically those existing in conventional hydroprocessing catalysts and can range from about 1–30 wt. % of the metal oxide, and more typically from about 10–25 wt. % of the oxide of the catalytic metal components, based on the total catalyst weight. The catalyst may be presulfided or sulfided in-situ, by well-known and conventional methods.

In one embodiment, a low metal loaded HDS catalyst comprising CoO and $MoO_3$ on a support, in which the Co/Mo atomic ratio ranges from 0.1 to 1.0, is particularly preferred for its deep desulfurization and high selectivity for sulfur removal. By low metal loaded it is meant that the catalyst will contain not more than 12, preferably not more than 10 and more preferably not more than 8 wt. % catalytic metal components calculated as their oxides, based on the total catalyst weight. Such catalysts include: (a) a $MoO_3$ concentration of about 1 to 10 wt. %, preferably 2 to 8 wt. % and more preferably 4 to 6 wt. % of the total catalyst; (b) a CoO concentration of 0.1 to 5 wt. %, preferably 0.5 to 4 wt. % and more preferably 1 to 3 wt. % based on the total catalyst weight. The catalyst will also have (i) a Co/Mo atomic ratio of 0.1 to 1.0, preferably 0.20 to 0.80 and more preferably 0.25 to 0.72; (ii) a median pore diameter of 60 to 200 Å, preferably from 75 to 175 Å and more preferably 80 to 150 Å; (iii) a $MoO_3$ surface concentration of $0.5\times10^{-4}$ to $3\times10^{-4}$ g. $MoO_3/m^2$, preferably $0.75\times10^{-4}$ to $2.4\times10^{-4}$ and more preferably $1\times10^{-4}$ to $2\times10^{-4}$, and (iv) an average particle size diameter of less than 2.0 mm, preferably less than 1.6 mm and more preferably less than 1.4 mm. The most preferred catalysts will also have a high degree of metal sulfide edge plane area as measured by the Oxygen Chemisorption Test described in "Structure and Properties of Molybdenum Sulfide: Correlation of $O_2$ Chemisorption with Hydrodesulfurization Activity", S. J. Tauster, et al., Journal of Catalysis, 63, p. 515–519 (1980), which is incorporated herein by reference. The Oxygen Chemisorption Test involves edgeplane area measurements made wherein pulses of oxygen are added to a carrier gas stream and thus rapidly traverse the catalyst bed. Thus, the metal sulfide edge plane area will be from about 761 to 2800, preferably from 1000 to 2200, and more preferably from 1200 to 2000 lmol oxygen/gram $MoO_3$, as measured by oxygen chemisorption. Alumina is a preferred support. For catalysts with a high degree of metal sulfide edge plane area, magnesia can also be used. The catalyst support material or component will preferably contain less than 1 wt. % of contaminants such as Fe, sulfates, silica and various metal oxides which can be present during preparation of the catalyst. It is preferred that the catalyst be free of such contaminants. In one embodiment, the catalyst may also contain from up to 5 wt. %, preferably 0.5 to 4 wt. % and more preferably 1 to 3 wt. % of an additive in the support, which additive is selected from the group consisting of phosphorous and metals or metal oxides of metals of Group IA (alkali metals).

The one or more catalytic metals can be deposited incorporated upon the support by any suitable conventional means, such as by impregnation employing heat-decomposable salts of the Group VIB and VIII metals or other methods known to those skilled in the art, such as ion-exchange, with impregnation methods being preferred. Suitable aqueous impregnation solutions include, but are not limited to a nitrate, ammoniated oxide, formate, acetate and the like. Impregnation of the catalytic metal hydrogenating components can be employed by incipient wetness, impregnation from aqueous or organic media, composited. Impregnation as in incipient wetness, with or without drying and calcining after each impregnation is typically used. Calcination is generally achieved in air at temperatures of from 500–1200° F., with temperatures of from 800–1100° F. being typical.

Following the hydrodesulfurization step, at least a portion of the hydrodesulfurization effluent is further processed in a second step to remove mercaptans, especially reversion mercaptans. As discussed, the second step may involve depressurizing the hydrodesulfurization effluent or by heating the hydrodesulfurization effluent at a substantially constant pressure. In one embodiment, the process is an integrated process wherein at least a portion of the hydrodesulfurized effluent is conducted directly from the first step in the vapor phase to the second step and wherein at least a portion of the heat produced in the exothermic HDS reaction of the first step is employed in the second step.

When high temperature depressurization is employed, mercaptan sulfur compounds may be removed from the hydrodesulfurization effluent without a substantial olefin loss in the effluent's naphtha component. Depressurization is typically used downstream of a catalytic naphtha hydrodesulfurization process, in which mercaptans are inherently produced, due to reaction of the $H_2S$ formed in the reactor with the olefins present in the naphtha feed. As mentioned above, the depressurization temperature will typically be about the same as the temperature of the hydrodesulfurized naphtha exiting the hydrodesulfurization reactor and preferably no less than about that temperature. Preferably, hydrodesulfurization effluent is in the vapor phase. The efficiency of the mercaptan removal from the hydrodesulfurized naphtha is highly temperature dependent and increases with increasing depressurization temperature. Thus, while some mercaptan removal will occur at temperatures lower than the temperature of the desulfurized naphtha exiting the hydrodesulfurization reactor, it will not Be as much as the amount removed at higher temperatures. The depressurization will typically, take place in a depressurization vessel downstream of the hydrodesulfurization reactor. While not wishing to be bound by any theory, it is believed that mercaptan destruction during depressurization results from a shift in the equilibrium reaction rate. In other words, if the mercaptan is represented as "RSH", then the rate of the mercaptan reversion reaction at constant temperature, olefin+$H_2S$→RSH, is equal to $k_1P_{olefin}P_{H2S}$, where $k_1$ is a second order rate constant, and $P_{olefin}$ and $P_{H2S}$ are the partial pressures of olefin and $H_2S$, respectively. The rate of mercaptan destruction, i.e., RSH→olefin+$H_2S$, equals $k_1P_{RSH}$ where $k_1$ is a first order rate constant and $P_{RSH}$ is the partial pressure of RSH. At equilibrium the rate of mercaptan reversion is equal to the rate of mercaptan destruction or $k_1P_{olefin}P_{H2S}=k_1P_{RSH}$. The equilibrium constant $K_{eq}$ is therefore $k_1/k_{-1}$ which equals $P_{RSH}/P_{olefin}P_{H2S}$. As the denominator is second order, concentration effects resulting from the depressurization would tend to decrease $P_{RSH}$.

When heating the hydrodesulfurization effluent is employed to convert the mercaptans, a gas-phase naphtha stream is heated downstream of a catalytic hydrodesulfurization process, in which mercaptans are inherently produced, due to reaction of the $H_2S$ formed in the reactor with the olefins present in the naphtha feed. As discussed, the equilibrium constant for mercaptan formation in the hydrodesulfurization effluent decreases approximately 40% with each temperature increase of about 25° C. Increasing the hydrodesulfurization effluent's temperature by about 100° C. would result in decreasing the equilibrium constant by about 85%. The hydrodesulfurized effluent of the HDS reactor may be heated with a furnace downstream of the hydrodesulfurization reactor. The now hot hydrodesulfurized effluent is then conducted to an adiabatic reactor vessel, which may contain a catalyst. While not wishing to be bound, it is believed that the equilibrium rate $K_{eq}$ decreases with increasing temperature even though both $k_1$ and $k_{-1}$ increase with temperature. Consequently, increasing temperature would increase the destruction of RSH species. This decrease in the equilibrium rate constant is supported by an evaluation of the change in the Gibbs function during heating. The change in Gibbs function ("ΔG") is related to the temperature, entropy, and enthalpy of the reaction by the relationship $\Delta G=\Delta H-T\Delta S$. The temperature dependence of $K_{eq}$ may be evaluated by relating this expression to the equation for $K_{eq}$ in terms of ΔG, $\Delta G=-RT\ Ln(K_{eq})$ to yield $Ln\ (K_{eq})=-(\Delta H-T\Delta S)/RT$ or $-(\Delta H/RT)+(\Delta S/R)$. This is the well-known van't Hoff relationship for the dependence of equilibrium constant on temperature. The inverse relationship of heating on $K_{eq}$ is now apparent in view of the influence of the exothermic nature of the reaction on the first term and the effect of adding heat on the second.

As with depressurization, the effluent must have sufficient time in the vessel to reach thermodynamic equilibrium following heating. Residence times may range from about 0.5 seconds to about 10 minutes, with the longer times being used for larger temperature changes. In a preferred embodiment, the effluent is heated to a final temperature between about 0° C. and about 100° C. as it flows through the reactor vessel at vessel space velocity in the range of about 2 to about 8 LHSV, based on the volume of the effluent, per volume of vessel, per hour.

FIGS. 1-A and 1-B illustrate preferred embodiments using depressurization and heating, respectively. Referring to FIG. 1-A, a block diagram flow plan of a naphtha desulfurizing process unit 10, according to one embodiment of the invention, comprises a hydrodesulfurization reactor 12, a depressurizing vessel 14, a separator 16, an amine scrubbing vessel 18 and a stripper 20. Also shown are a heat exchanger 22 and a compressor 24. For the purposes of the illustration, a vaporized sulfur and olefin-containing intermediate naphtha feed, containing 2000 wppm total sulfur and 30 vol. % olefins, is passed from a cat cracker (not shown) into the top of reactor 12, via lines 26 and 28. Such an intermediate cat naphtha may be obtained from, for example, a naphtha splitter, and have a typical lower boiling point will range from about 120° F. to about 160° F. and a typical upper boiling point in the range of about 240° F. to about 350° F. The naphtha may be pre-heated prior to hydrodesulfurization, for example in a furnace or a heat exchanger. When employed, the heat exchanger may use other species separated in the splitter such as heavy and light cat naphtha to heat the intermediate cat naphtha. At the same time, fresh hydrogen or a hydrogen treat gas, along with substantially sulfur-free recovered and recycled unreacted hydrogen is also passed into the top of the reactor, via line 30. Reactor 12 contains one or more fixed beds 34 of desulfurizing catalyst. The one or more beds may or may not contain more than one desulfurizing catalyst. The temperature, total pressure and space velocity and treat gas ratios in the reactor are 525–650° F., 200–300 psig, 2–8 LHSV and 1000–2000 scf/b, respectively. Hydrogen partial pressure at the reactor outlet typically ranges from about 100 psig to about 200 psig. The catalyst comprises Co and Mo on alumina, with low catalytic metal loading of a total of no more than 12 wt. %, for reduced olefin loss through saturation, while maintaining high levels of total desulfurization. However, the invention is not intended to be limited to the use of low metals loaded hydrodesulfurization catalysts. The hydrogen reacts with the sulfur compounds in the presence of the hydrodesulfurization catalyst, to desulfurize the naphtha by removing the sulfur as $H_2S$. The desulfurization effluent exiting the HDS reactor is a mixture, preferably a gaseous mixture, comprising a mercaptan-containing and sulfur-reduced naphtha, unreacted hydrogen and $H_2S$. The naphtha in the effluent preferably contains an equilibrium level of 420 wppm total sulfur and 85 wppm mercaptan sulfur. The olefin loss is represented by an 18% reduction in the naphtha Bromine Number.

Further processing of the hydrodesulfurization effluent in the second step to remove mercaptans may proceed, as discussed, via at least one of (i) a rapid depressurization of the hydrodesulfurization effluent, and (ii) a heating thereof. When rapid depressurization is employed, at least a portion of the hydrodesulfurization effluent, at the temperature and pressure at the downstream end of the HDS reactor, passes out of the downstream end (i.e., the bottom) of the HDS reactor and into the depressurizing vessel 14, via line 36. In the depressurizing vessel, the pressure of the mixture is reduced to a level of about 10% of the exit end pressure in the hydrodesulfurizing reactor. For example, if the pressure at the exit end in the hydrodesulfurization reactor is 300 psig, the mixture is depressurized to about 30 psig in vessel 14. The residence time of the vapor at 30 psig in the depressurization vessel is about 1 second and the gas mixture exiting out the bottom of the vessel, via line 38, now has a mercaptan sulfur content of about 8.5, for a ten-fold reduction in mercaptan sulfur. The required residence time in the depressurization vessel is dependent on whether a catalyst is utilized in the vessel and on the length of time requires for the system to thermodynamically equilibrate at the lower pressure. Generally the residence time should be maintained between about 0.5 second and several minutes with greater depressurization requiring longer residence times. When a catalyst is used the residence time should be a few seconds or less, while if a catalyst is not used longer residence times may be required. Conventional pressure reduction means such as a back-pressure regulator or Joule valve may be used to provide the pressure reduction.

In a preferred embodiment, the hydrotreated effluent will flow continuously from a high pressure region to a low pressure region. For total pressure differentials in the range of about 100 to about 300 psig, the residence time may be calculated directly for a vessel space velocity in the range of about 2 to about 8 LHSV, where the vessel LHSV is based on the volume of effluent, per volume of vessel, per hour.

FIG. 1-B illustrates a similar flow plan that may be employed when hydrodesulfurization effluent heating is employed for mercaptan removal. It should be noted that the hydrodesulfurization step may be operated under similar or even identical conditions for mercaptan removal via depressurization, heating, or some combination thereof. For heating, and referring now to FIG. 1-B, at least a portion of the hydrodesulfurization effluent at the temperature and pressure at the downstream end of the HDS reactor 12 passes out of the bottom of the reactor and into furnace 21 via line 36. In furnace 21 the effluent is heated to at least 25° C., more preferably at least 50° C. and most preferably at least 100° C. above the exit temperature of reactor 12. The hot mixture is then sent to the high temperature mercaptan decomposition reactor 14, via line 37. At 100° C. higher temperature, the mercaptan content of the mixture will be reduced approximately 85%. The reduced mercaptan mixture exits via line 38 and is then cooled in heat exchanger 22, which cools down the mixture to 38° C., thereby condensing the naphtha to liquid and preventing the reformation of mercaptans. In an additional embodiment of this invention the heat removed from the exit stream can be used to heat the feeds to reactor 12 or reactor 14.

In a preferred embodiment, additional hydrogen treat gas may be employed in the process, for example by adding treat gas to the feed to the main HDS reactor 12 or into the exit mixture from reactor 12 before the furnace 21. This additional treat gas will result in lower partial pressures of mercaptan, hydrogen sulfide and olefin and thereby increasing decomposition.

Figure 1B:
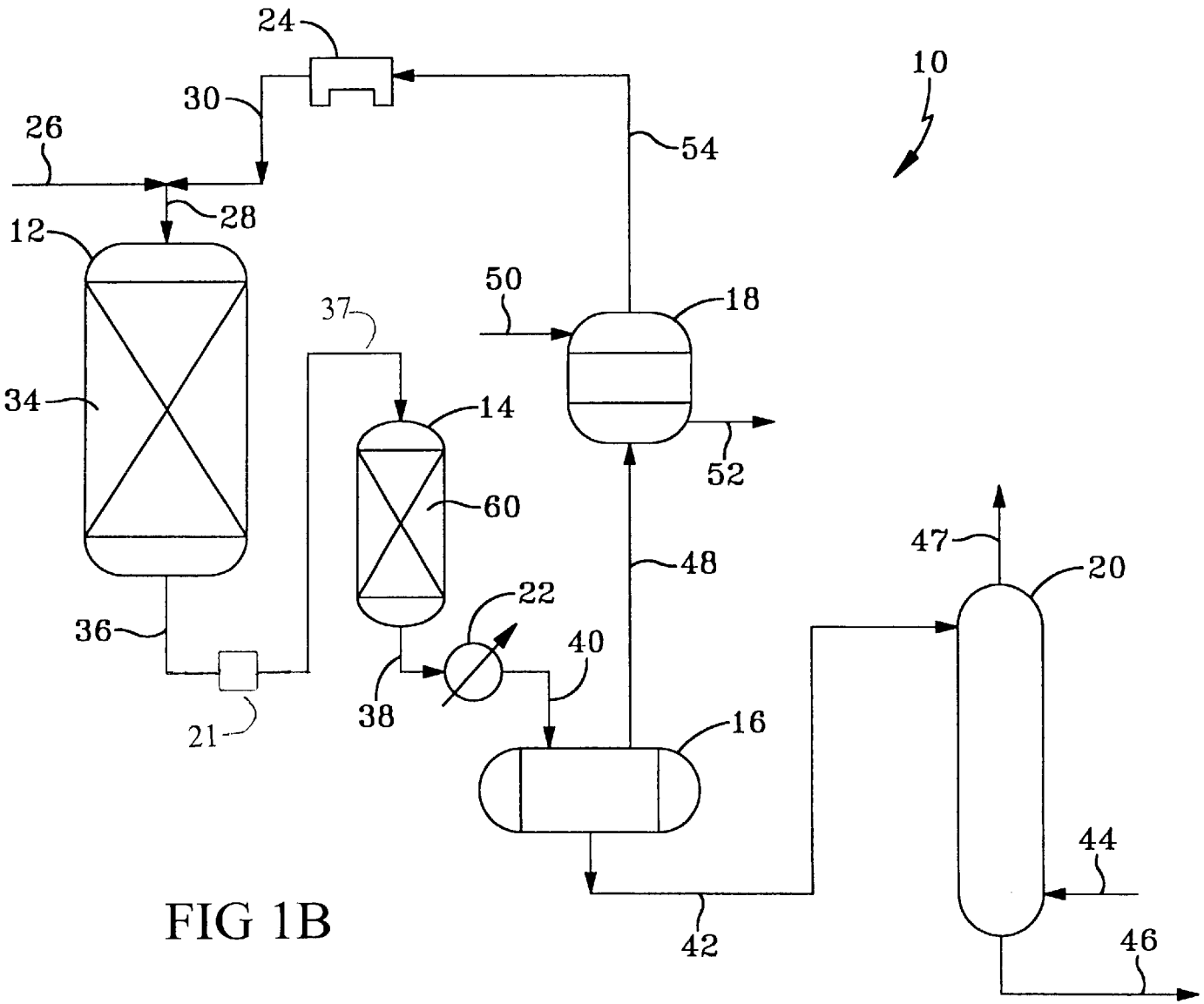
FIG. 1B is a block diagram flow plan of a naphtha desulfurizing process according to one embodiment of the invention involving heating of the hydrodesulfurization effluent.

Referring now to either FIG. 1A or 1B, the treated effluent exiting the downstream end of reactor 60 passes through a heat exchanger 22, which cools it down to a temperature of 100° F., thereby condensing the naphtha to liquid and preventing the reformation of mercaptans. The mixture of liquid naphtha, unreacted hydrogen, light (e.g., ~$C_{4-}$) hydrocarbon vapors produced in reactor 12, and $H_2S$ passes, via line 40, into separator vessel 16, which in this embodiment is a simple drum separator. In the separator, the liquid naphtha separates from the gasses and vapors, is withdrawn from the separator via line 42 and passed into the top of stripper 20. A methane striping gas is passed into the bottom of the stripper, via line 44, and strips out any dissolved $H_2S$ from the desulfurized naphtha. The clean, stripped liquid naphtha may be removed from the bottom of the stripper via line 46, and may be conducted away from the process for, for example, storage, further processing, and to a mogas blending pool. The $H_2S$-containing methane stripping gas is removed from the top of the stripper via line 47. The separated gas and vapor effluent containing the $H_2S$ and unreacted hydrogen, is removed from the separator via line 48, and passed into a scrubber 18, in which an aqueous amine solution, entering the top via line 50, removes the $H_2S$ from the unreacted hydrogen and remaining vapors. The $H_2S$-laden amine solution exits the bottom of the scrubber via line 52 and may be sent to, e.g., a Claus plant for sulfur removal and amine recovery. The scrubbed, hydrogen-rich and desulfurized gas may be removed from the top of the scrubber and recycled back into reactor 12 via line 54, compressor 24, and lines 30 and 28.

In another embodiment, a preferred embodiment used in connection with either depressurization or high temperature effluent treatment, the depressurization or high temperature vessel will have a catalyst bed 60, which contains a material that catalyzes the mercaptan reversal back to $H_2S$ and olefins. This substantially reduces the naphtha residence time in the depressurizer vessel, thereby permitting the use of a smaller vessel. Suitable catalytic materials for this process include refractory metal oxides resistant to sulfur and hydrogen at high temperatures and which possess little or no hydrogenation activity. Illustrative, but nonlimiting, examples of these materials include neutral and alkaline materials such as alumina, silica, both crystalline and amorphous silica-alumina, aluminum phosphates, titania, magnesium oxide, alkali and alkaline earth metal oxides, alkaline metal oxides, magnesium oxide supported on alumina, faujasite that has been ion exchanged with sodium to remove the acidity and ammoniun ion treated aluminum phosphate.

Figure 2:
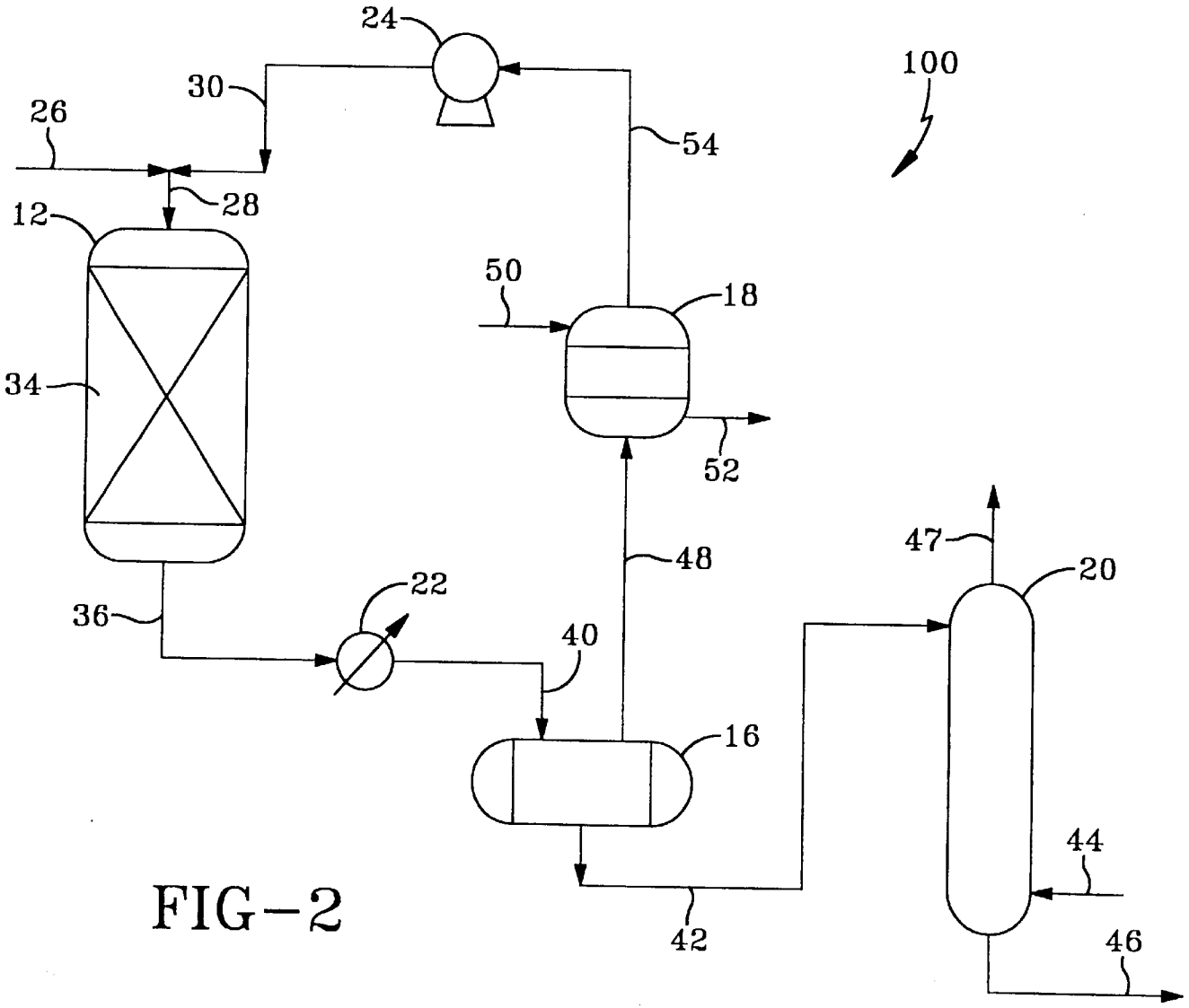
FIG. 2 is a block diagram flow plan of a conventional naphtha desulfurizing process.

By way of a simple contrast with the process of the invention, FIG. 2 is a block diagram flow plan of a conventional naphtha desulfurizing process unit 100. For convenience, those vessels and lines common to both figures and which perform the same function have the same numbers. Referring to FIG. 2, the process scheme is the same except for absence of the depressurization vessel 14 and line 38. The naphtha exiting the desulfurization reactor vessel 12 therefore has the same properties as in that part of the process of the invention shown in FIG. 1A. However, the total sulfur, mercaptan sulfur and olefin levels in the naphtha going to the mogas pool via line 46, remain the same as they are in line 36. These are 420 wppm total sulfur and 85 wppm mercaptan sulfur. The olefin loss is the same for both cases.

The invention will be further understood with reference to the examples below.

EXAMPLES

Example 1

Figure 3:
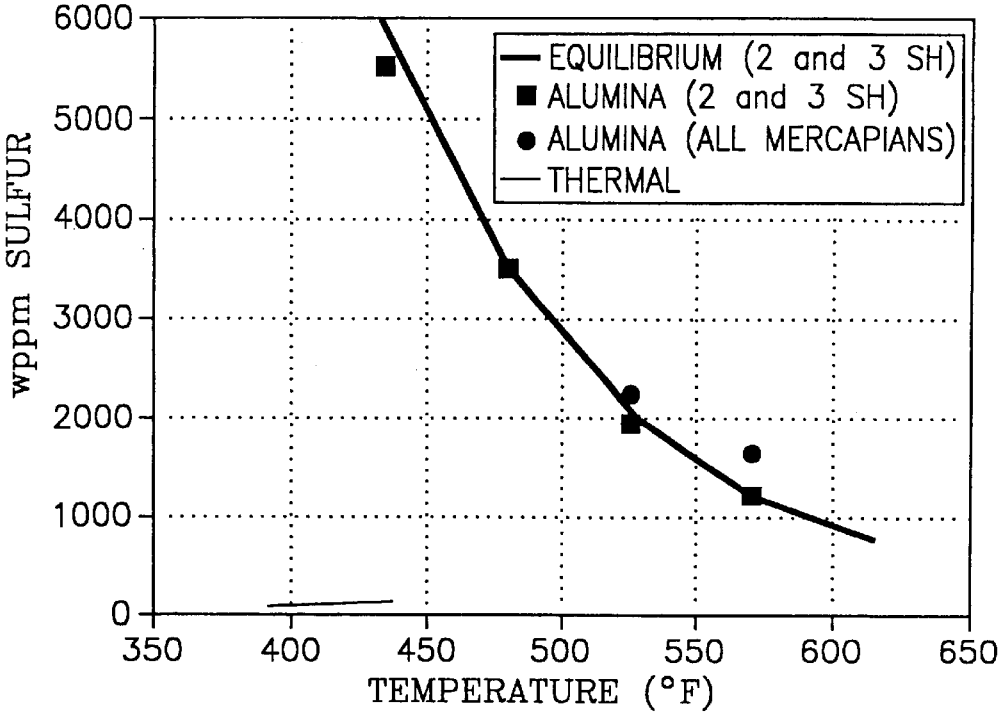
FIG. 3 is a graph illustrating the effects of $H_2S$ addition to an olefin, as a function of temperature.

In this experiment, the rate of thermal and alumina catalyzed reaction of $H_2S$ and 2-pentene were examined in a fixed bed, downflow gas phase microreactor equipped with an on-line HP 6890 Gas Chromatograph (GC) equipped with both a Flame Ionization Detector (FID) and a Sievers Sulfur Chemiluminesense Detector (SCD). For the non-catalyzed thermal reaction, the reactor was filled with approximately 33 cc of low surface area Coors Beads, which are essentially inert with respect to the reaction. For the alumina-catalyzed reaction, 2 cc of the Coors Beads were replaced with 2 cc of γ-alumina (Ketjen). The results for both reactions are shown in FIG. 3. These results show that simple gamma alumina, a well known and widely used support for hydrodesulfurization catalysts, is an effective catalyst for producing essentially equilibrium mixtures and $H_2S$ and mercaptans at temperatures above about 480° F. In contrast, the uncatalyzed reaction of $H_2S$ with olefins proceeds at significantly slower rates. These results demonstrate that substantially all of the reversion mercaptans formed in naphtha hydrodesulfurizing occur in the hydrodesulfurization reactor itself and not downstream of the reactor.

Example 2

Figure 4:
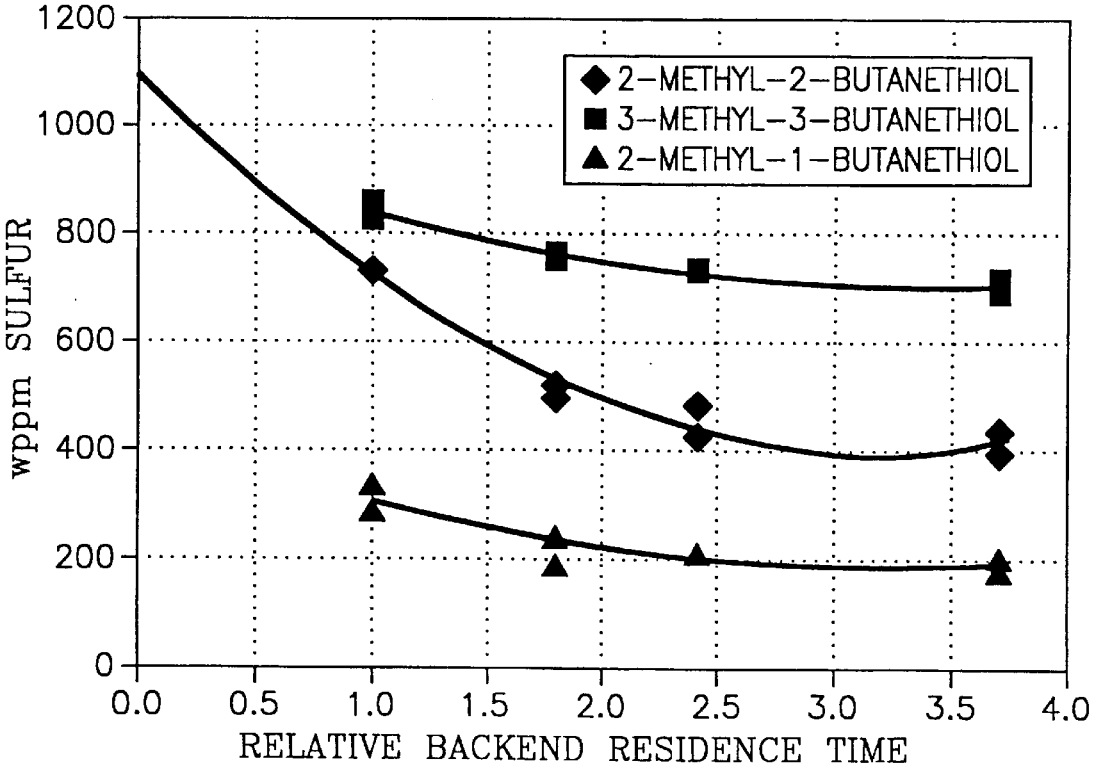
FIG. 4 is a graph of mercaptan decomposition as a function of time under depressurization.

The same microreactor used in Example 1 was also used in this experiment. In this experiment, 2-methyl-2-butene (22 psi) and $H_2S$ (1.75 psi) were reacted in the presence of the γ-alumina at 435° F., 215 psia, and 20 LHSV. This is adequate to produce equilibrium levels of 2-methyl-2-butenethiol out of the reactor. The reactor effluent was depressurized to 15–20 psia into a hot (nominally 338° F.) transfer line, in which it was passed to the GC for analysis. The addition of nitrogen to the reactor vapor effluent enabled adjustment of the residence time of the effluent in the transfer line. Thus, increasing the nitrogen flow into the vapor decreased the residence time and vice versa. FIG. 4 is a graph of the amount of mercaptan in the GC as a function of the relative residence time of the reactor vapor effluent in the transfer line. The 1100 wppm sulfur is the mercaptan sulfur content of the naphtha as it comes out of the reactor before depressurization. These data demonstrate the efficacy of depressurization for reducing the mercaptan sulfur content of the naphtha.

Example 3

A series of catalytic materials were examined for their ability to decompose mercaptans to the parent olefin and hydrogen sulfide. These materials included γ—alumina, Coors Beads, LZY-52 (NaY), Cl/γ-alumina, $NH_3$-$AlPO_4$ and $MgO/Al_2O_3$. The γ-alumina was a commercial γ-alumina having a surface area of about 170 $m^2/g$. The 1.2 wt. % Cl on alumina was prepared by impregnating ammonium chloride on alumina followed by w high temperature calcination. The LZY-52 was a commercially available sodium exchanged Y-faujasite, while the $MgO/Al_2O_3$ was prepared by calcining magnesium aluminate hydrotalcite at 500° C. A precipitated aluminum phosphate was evaluated, along with an aluminum phosphate pretreated with ammonia at 800° C. ($NH_3$–$AlPO_4$). Sodium oxide on alumina (3 wt. % Na-$Al_2O_3$) was prepared by impregnating alumina with sodium nitrate, followed by calcining at 400° C.

The catalytic activity for mercaptan destruction of 2000 wppm sulfur in the form of 1 heptanthiol was determined. The 1 -heptanethiol was dissolved in a solution of 67 wt. % m-xylene and 33 wt. % 1-octene. In addition, the catalytic activity for the destruction of 500 wppm sulfur in the form of benzothiophene was determined as a reference standard, for comparison. The tests were conducted in an all vapor phase, upflow microreactor at 200 and 300° C. For all the tests, the pressure in the reactor was maintained at 50 psig, the hydrogen treat gas (100% $H_2$) ration was 5000 scf/b, and the liquid hourly space velocity was 1. The reactor effluent was cooled to condense to liquid, reaction products that were liquid at standard conditions of room temperature and pressure. These products were analyzed using high-resolution capillary gas chromatography utilizing both Flame Ionization Detection and Sulfur Luminescence Detection (FID). The results at 200° C. are shown in Table 1, while those at 300° C. are shown in Table 2. The percent $C_7$—SH conversion refers to the mole percent destruction of the 1-heptanethiol and reflects the activity of the catalyst for the mercaptan destruction back into $H_2S$.

The percent selectivity to $H_2S$, octyl mercaptan ($C_8SH$), and heptyl octyl sulfide ($C_7$—S—$C_8$) reflects the mole % of the heptane thiol sulfur that is respectively (i) converted to $H_2S$, (ii) transferred to feed octene to form octyl mercaptan, or (iii) adds feed octenes to form the heptyl octyl sulfide. The desired reaction is the formation of $H_2S$. As the data in these two Tables show, materials that are considered to be neutral or basic provide superior performance, as reflected in more total organic sulfur destruction into $H_2S$. No detectable olefin saturation, as determined by the FID, was detectable over any of the catalysts.

TABLE 1

| Catalyst | % $C_7$—SH Conversion | % $H_2S$ Selectivity | $C_8SH$ | $C_7$—S—$C_8$ |
|---|---|---|---|---|
| Thermal (Coors Beads) | 10 ± 3 | 63 ± 4 | — | 37 ± 4 |
| LZY-52 (NaY) | 13 ± 4 | 48 ± 1 | — | 52 ± 1 |
| 1.2 wt. % Cl/γ-$Al_2O_3$ | 15 ± 4 | 21 ± 3 | 11 ± 1 | 68 ± 3 |
| $NaH_3$—$AlPO_4$ | 30 ± 4 | 84 ± 4 | — | 16 ± 4 |
| γ-$Al_2O_3$ | 74 ± 1 | 55 ± 3 | 19 ± 1 | 26 ± 3 |
| MgO—$Al_2O_3$ | 74 ± 1 | 74 ± 9 | 4 ± 1 | 22 ± 9 |

TABLE 2

| Catalyst | % $C_7$—SH Conversion | % $H_2S$ Selectivity | $C_8SH$ | $C_7$—S—$C_8$ |
|---|---|---|---|---|
| Thermal (Coors Beads) | 43 ± 4 | 90 ± 1 | 1 | 9 ± 1 |
| $AlPO_4$ | 48 | 95 | 5 | — |
| LZY-52 (NaY) | 67 ± 4 | 100 ± 1 | — | — |
| 3.8 wt. % NaOγ-$Al_2O_3$ | 68 ± 4 | 99 ± 1 | 1 | 1 |
| $NH_3$—$AlPO_4$ | 80 ± 1 | 98 ± 1 | 2 ± 1 | — |
| MgO—$Al_2O_3$ | 89 ± 5 | 83 ± 6 | 42 ± 1 | 15 ± 6 |

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A naphtha desulfurization process, comprising (a) hydrodesulfurizing a naphtha which contains olefins and sulfur in the form of organic sulfur compounds, to form a hydrodesulfurization effluent at an initial temperature, the hydrodesulfurization effluent comprising a hot mixture of sulfur reduced naphtha at an initial pressure, $H_2S$ and mercaptans, and then (b) rapidly depressurizing for a depressurization time at least a portion of the hydrodesulfurization effluent to destroy at least a portion of the mercaptans to form more $H_2S$ and a depressurized naphtha further reduced in sulfur.

2. A process according to claim 1 wherein the hydrodesulfurizing is conducted in the presence of a catalytically effective amount of a hydrodesulfurizing catalyst under catalytic hydrodesulfurization conditions, wherein the hydrodesulfurizing catalyst comprises at least one Group VIII catalytic metal component and a support component, and wherein said naphtha feed contains at least 0.1 wt. % sulfur.

3. A process according to claim 1 wherein said hot mixture is depressurized to a final pressure of no more than 50% of the initial pressure, wherein said depressurization temperature is no less than the initial temperature, and wherein the depressurization time is sufficient for the effluent to reach thermodynamic equilibrium at the final pressure.

4. A process according to claim 2 wherein the catalytic metal component contains at least one Group VIII metal and at least one Group VI metal.

5. A process according to claim 2 further comprising separating said $H_2S$ from said depressurized naphtha.

6. A process according to claim 5 wherein said hydrodesulfurizing catalyst comprises Co and Mo catalytic metal components and wherein said naphtha feed contains from 0.1 to 0.7 wt. % sulfur in the form of organic sulfur compounds, and from 5 to 60 vol. % olefins.

7. A process according to claim 4 wherein the final pressure ranges from about atmospheric pressure to about 300 psig, and the depressurization time ranges from 0.5 seconds to 10 minutes.

8. A process according to claim 3 wherein said depressurization temperature is greater than the initial temperature.

9. A process according to claim 8 wherein the total amount of said Co and Mo catalytic metal components, calculated as CoO and $MoO_3$ is no greater than 12 wt. % of the total weight of said catalyst.

10. The process of claim 1, further comprising conducting the rapid depressurizing in the presence of a second catalyst in an amount effective to catalyze the decomposition of said mercaptans to $H_2S$.

11. The process of claim 10 wherein the second catalyst comprises at least one neutral or alkaline metal oxide.

12. The process of claim 1 wherein the hydrodesulfurization conditions include a temperature of from 400–800° F. and a pressure of from 60–2000 psig, a space velocity of about 0.1 to about 10, and a hydrogen treat gas rate of about 200 to about 5000 scf/b.

13. The process of claim 11 wherein hydrogen is present during the rapid depressurization.

14. The process of claim 11 wherein the second catalyst is alumina.

15. The process of claim 11 wherein the second catalyst does not have a hydrogenation function.

16. A naphtha desulfurization process, comprising:

(a) hydrodesulfurizing a naphtha, the naphtha containing olefins and sulfur in the form of organic sulfur compounds, to form a hydrodesulfurization effluent at an initial temperature, the effluent comprising a hot mixture of sulfur reduced naphtha, $H_2S$ and mercaptans; and then (b) heating at least a portion of the hydrodesulfurization effluent to a final temperature greater than the initial temperature at a substantially constant total pressure for a heating time to destroy at least a portion of the mercaptans to form more $H_2S$ and a treated naphtha further reduced in sulfur.

17. The process of claim 16, further comprising separating the $H_2S$ from the treated naphtha.

18. A process according to claim 17 wherein the hydrodesulfurizing is conducted in the presence of a catalytically effective amount of a hydrodesulfurizing catalyst under catalytic hydrodesulfurization conditions, wherein the hydrodesulfurizing catalyst comprises at least one Group VIII catalytic metal component and a support component, and wherein said naphtha feed contains at least 0.1 wt. % sulfur.

19. A process according to claim 18 wherein the catalytic metal component contains at least one Group VIII metal and at least one Group VI metal.

20. A process according to claim6 wherein said hydrodesulfurization catalyst comprises Co and Mo catalytic metal components and wherein said naphtha feed contains from 0.1 to 0.7 wt. % sulfur in the form of organic sulfur compounds, and from 5 to 60 vol. % olefins.

21. A process according to claim 16 wherein the final temperature ranges from about 0° C. to about 100° C. above the initial temperature and wherein the heating time ranges from about 0.5 seconds to about 10 minutes.

22. A process according to claim 20 wherein the total amount of said Co and Mo catalytic metal components, calculated as CoO and $MoO_3$ is no greater than 12 wt. % of the total weight of said catalyst.

23. The process of claim 16, further comprising conducting the heating in the presence of a second catalyst in an amount effective to catalyze the decomposition of said mercaptans to $H_2S$.

24. The process of claim 23 wherein the second catalyst wherein the second catalyst comprises at least one neutral or alkaline metal oxide.

25. The process of claim 18 wherein the hydrodesulfurization conditions include a temperature of from 400–800° F. and a pressure of from 60–2000 psig, a space velocity of about 0.1 to about 10, and a hydrogen treat gas rate of about 200 to about 5000 scf/b.

* * * * *